United States Patent [19]

Carlyle

[11] Patent Number: 4,483,163

[45] Date of Patent: Nov. 20, 1984

[54] GAS SUPPLY TANK LOCK CAP

[76] Inventor: John L. Carlyle, P.O. Box 377, Mercury, Nev. 89023

[21] Appl. No.: 395,490

[22] Filed: Jul. 6, 1982

[51] Int. Cl.[3] ..... B65D 55/14

[52] U.S. Cl. ..... 70/165; 70/231

[58] Field of Search ..... 70/175–180, 70/231, 232, 188, 218, 222, 223, 163, 165; 292/DIG. 2, 205

[56] References Cited

U.S. PATENT DOCUMENTS

| | | | |
|---|---|---|---|
| 1,642,589 | 9/1927 | Loomis | 70/178 X |
| 1,645,917 | 10/1927 | Maszczyk | 70/231 |
| 1,678,174 | 7/1928 | White | 70/231 |
| 1,685,924 | 10/1928 | Lee | 70/178 X |
| 1,812,334 | 6/1931 | Gloekler | 292/205 |
| 1,858,893 | 5/1932 | Heyer | 70/231 X |
| 2,019,262 | 10/1935 | Kauffman | 70/231 X |
| 3,477,607 | 11/1969 | Fuzzell et al. | 70/188 X |
| 4,073,168 | 2/1978 | Takada | 70/218 X |
| 4,336,698 | 6/1982 | Hurd | 70/231 |

FOREIGN PATENT DOCUMENTS

| | | | |
|---|---|---|---|
| 463602 | 7/1928 | Fed. Rep. of Germany | 70/231 |
| 296860 | 9/1928 | United Kingdom | 70/231 |
| 288323 | 10/1928 | United Kingdom | 70/231 |

*Primary Examiner*—Thomas J. Holko
*Assistant Examiner*—Thomas J. Dubnicka
*Attorney, Agent, or Firm*—Joseph L. Strabala

[57] ABSTRACT

Two caps are axially nested so that a smaller inner threaded cap is free to rotate within the outer larger protective cap and retained therein to form a security lock cap unit for gas supply tanks. It includes a locking means associated with the outer cap whereby the inner cap can be selectively engaged by the locking means to prevent its relative rotation, allowing the inner cap to be screwed on to a gas supply tank by rotating the outer protective cap and thereafter the inner cap is released by the locking means and retained in a disengaged position to prevent removal of the locking cap unit without a key to the locking means.

3 Claims, 4 Drawing Figures

GAS SUPPLY TANK LOCK CAP

BACKGROUND

Reusable oxygen and acetylene tanks (hereinafter referred to a "gas supply tanks") are employed in great numbers on construction sites. These tanks provide the fuel for welding and cutting operations periodically necessary for the construction projects. Unfortunately, during the course of such construction projects, many of such tanks mysteriously disappear. To the contractor, the loss of these reusable tanks can represent a substantial financial loss.

There is no simple way to mark the tanks since they are reusable and are exchanged when empty for full tanks.

Also, there is no easy way to distinguish an empty tank from a full tank in appearance and it is necessary to weigh the tanks to determine the amount of remaining gas left therein. This factor makes it difficult to determine if persons removing tanks are removing full or empty tanks from a construction site, unless some means are provided to weigh the tanks.

Normally, these tanks include a removable threaded cap which is screwed on to the top of the tanks, over the valve stem, to protect the valve stem assembly. However, these caps can be removed at will and often are by vandals who subsequently open the valves and vent the contents of the tanks to the atmosphere. With oxygen and acetylene tanks in close proximity, such acts of vandalism can also create a safety hazard.

Many of the above problems can be overcome with the lock cap unit of the instant invention which provides a cap which can be locked over the valve stem assembly that cannot be removed without a key to its locking unit. Further, a contractor can identify its tanks with the lock cap units installed thereon by painting them with special colors or relying on their serial numbers, since these cap units cannot be removed except when the contractor desires to remove a unit with a key. Further, the installation of the lock cap unit makes it difficult for thieves to market gas supply tanks which contain the lock cap unit because it is difficult, if not impossible, to safely remove it from the tank without the key.

Of course, other advantages besides those noted above, such as protection against vandalism, are provided by the novel lock cap unit.

Further, the lock cap unit is not restricted to oxygen and acetyline supply tanks being suitable for LP gas tanks, nitrogen, etc., which have a threaded neck.

SUMMARY OF THE INVENTION

A lock cap unit for gas supply tanks includes an outer cylindrical sleeve cap, an inner threaded tank cap axially nested and rotatably received within said sleeve, retaining means attached to the sleeve cap securing said tank cap therein in a manner operable to allow relative rotation between said caps, latching means fixedly attached to the outer cylindrical sleeve cap, said locking means having a key element operable to engage and disengage said threaded tank cap through an aperture in said cylindrical sleeve cap whereby said key element can be engaged to lock said caps against relative rotation and disengaged to allow relative rotation whereby the lock cap unit can be screwed over the valve assembly of a gas supply tank and said locking means can be locked in a position whereby its key element is disengaged from the inner cap thereby preventing the removal of the lock cap unit from the gas supply tank until the key element is repositioned.

DESCRIPTION OF THE DRAWINGS

The instant invention will be better understood in reference to the accompanying drawings when taken in conjunction with the description in this specification; the drawings are described as follows.

DESCRIPTION OF AN EMBODIMENT OF AN INVENTION

Figures 1, 2, 3, 4:
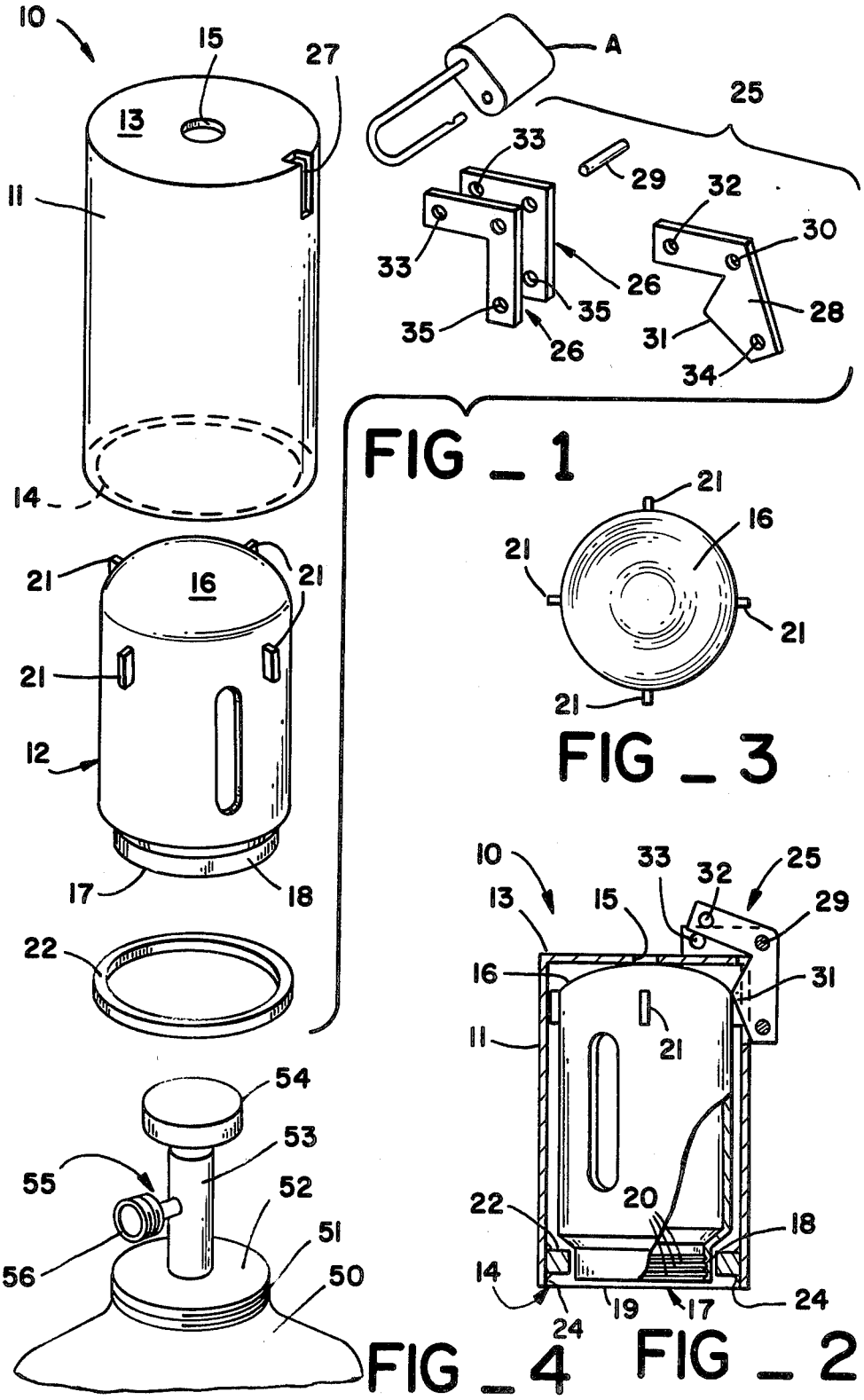
FIG. 1 is an exploded perspective of the tank lock cap unit showing an embodiment of the invention.
FIG. 2 is a transverse section of the tank lock cap unit with parts of the inner cap broken away to show the additional detail of the threaded mouth of the inner cap.
FIG. 3 is a plan view of the top of the inner cap which is axially nested with the larger outer cylindrical sleeve cap.
FIG. 4 is a broken away perspective of the top of a gas supply tank showing the valve stem assembly typically found at the tops of oxygen and acetylene gas supply tanks and other similar supply tanks.

FIG. 2 illustrates the tank lock cap unit 10 of the invention in section. It shows the two major components of the lock cap unit which can be assembled on to the top of typical gas supply tanks to protect the valve stem assemblies. The unit, once in place, cannot be removed unless a key to its locking assembly is available. As indicated above, the unit is composed of two principal parts which are the outer cylindrical sleeve cap 11 and the smaller inner tank cap 12.

In reference to the cylindrical sleeve cap 11, it is cylindrical in design and has a closed end 13 and an open end 14 to form the cap structure. A vent aperture 15 is fashioned in the closed end of this cap to prevent accumulation of gas within the cap should the valve stem assembly leak. This avoids explosive accumulations of oxygen or acetylene within the cap structure when it is in use. Basically, this outer cap is constructed of heavy gauge metal, usually of steel, from one-eight of an inch to three-eighths of an inch in thickness, which steel can be hardened after the cap is fabricated if desired.

Nested inside the sleeve cap 11 is a tank cap 12. This cap is shaped substantially like the ordinary approved protective cap used for oxygen and acetylene gas supply tanks. Like the larger sleeve cap, it has a closed end 16, which is typically rounded, and an open end 17 which has a necked-in portion 18, that is best shown in FIGS. 1 and 2. Its open end has a mouth 19 and is threaded with a threads 20 which can be screwed on to the top of the gas supply tank. These two caps are assembled axially with the smaller threaded tank cap 12 inserted axially into the larger cylindrical cap 11. To stabilize the smaller cap in the larger one four lugs or ears 21 are circumferentially spaced near the top of this cap. Normally these lugs or ears are equally spaced about the top of the cap and project outwardly an equal distance from its surface so that a small clearance is provided between their distal ends and the inner cylindrical surface of the sleeve cap. Once the smaller cap has been inserted into the larger cylindrical cap, a retainer ring 22 is inserted into the mouth 14 of the cylindrical cap. This is best shown in FIGS. 1 and 2. The ring is designed to fit snugly into the mouth of the cylindrical cap and its aperture is sized to receive the necked-in portion 18 of the inner cap, leaving a small clearance therebetween, as shown in FIG. 2.

As can be seen best in FIG. 2, the ring 22, once in place, is welded to the inner periphery of the mouth of the outer sleeve cap with a weld 24. After this assembly is made, the inner threaded cap 12 is free to rotate within the larger cylindrical cap unit. Further, since the outer cap 11 forms a complete shroud about the inner cap when the latter is screwed onto the gas supply tank there is no way to access the inner cap within the larger cap to rotate it.

To provide a means whereby the relative rotation between the two caps can be selectively controlled, a locking means 25 is utilized. This locking means 25 includes four parts which cooperate with the outer sleeve element. However, in respect to this locking means, it is to be understood it is only one embodiment that might be utilized with the instant invention. Typically this unit may employ a conventional paddle lock to lock the key element of the unit (hereinafter described) in either an engaged or disengaged position when the cap is in use.

More specifically referring again to FIGS. 1 and 2, the locking means is composed of a pair of L-shaped brackets 26 which are secured in a spaced apart relationship on the outer cylindrical cap 11 so the legs of these L-shaped brackets extend across the top and down the side of this cap as best shown in FIG. 2. They are attached to the cap on opposite sides of a slotted aperture 27 formed in the top of cap 11, typically by welding them to the cap. Once the brackets are assembled on the outer cylindrical cap, a key element 28 is inserted between these spaced apart brackets 46 and secured for rocking articulation on pin 29 extending through its central aperture 30 of these brackets so that the key element can rock about the pin. This key element is semi-L-shaped and includes a tooth 31 which, as the key is rocked, moves into and out of the cylindrical sleeve 11 through the slotted aperture, as best seen in FIG. 2. The design of the key element is such that it can be controlled between two positions. These positions are determined by holes in the L-shaped brackets 26 and mating holes in key element 28.

As can be seen in FIGS. 1 and 2, the key element can be positioned so that its aperture 32 of the key element aligns with apertures 33 of the L-shaped brackets. In this position, which can be seen by reference to FIG. 2 that the tooth 31 will be sufficiently withdrawn from the slotted aperture 27 in the cylindrical sleeve 11 so that the lugs 21, which it would otherwise engage, will not be engaged as the outer cap is rotated relative to the inner cap. A paddle lock A shown in FIG. 1 can be inserted through the aligned apertures 32 and 33 thereby locking the key element in its disengaged position. Other types of locks can be used.

In the above condition, the outer cap will rotate freely about the inner cap, until the paddle lock is removed from aligned apertures 32 and 33 and the key element is repositioned. When desired, the key element can be locked in the engaged position by removing the paddle lock A from aligned holes 32 and 33 and thereafter rocking the key element 28 so that its aperture 34 aligns with apertures 35 in the L-shaped brackets 26. This position is shown in FIG. 2. Also, it can be appreciated if the paddle lock is inserted in the aligned apertures 34 and 35 the key element will be locked in an engaged position whereby rotation of the outer cap 11 in either direction will rotate the inner cap with it when the key element engages one of the lugs 21.

In reference to the locking means, it can also be appreciated that other types of locking means might be employed, such as a key element which would allow the tooth element to be moved axially relative to the caps from an engaged to a disengaged position. Further, the paddle lock can be fixedly incorporated in the brackets of the locking means itself in another embodiment.

In operation, once the unit has been completed, the position of the key element 28 would be adjusted to the one shown in FIG. 2. Thereafter the lock cap unit 10 can be assembled on a gas supply tank, such as the one shown in FIG. 4. In reference to FIG. 4, the top of the gas supply tank 50 is shown in perspective. Its neck portion contains threads 51 and on the top of the neck portion 52, a valve assembly 53 is assembled. This valve assembly projects axially from the top of the tank and terminates in a valve handle 54. On this valve stem assembly projecting normally thereto, is a fitting 35 which terminates in a threaded nipple 56. Normally the torch gauge and reducing valve assemblies are coupled to this nipple when the tank is in use. Typically after disconnecting these assemblies a protective cap is assembled on the top of the tank to protect its valve stem when it is not in use. Similar to the conventional protective cap, the instant lock cap unit can be assembled on the tank as described below.

With the key element 28 in the engaged position, as shown in FIG. 2, the inner cap will be locked with the outer cap. By rotating the latter the lock cap unit can be screwed on to the top of a gas supply tank. Good purchase can be obtained on the large cap so that the threads 20 can be tightened on the threads 51 on the tank. Thereafter the key element 28 can be articulated so that holes 32 and 33 come into alignment, and thereafter paddle lock A can be inserted into these aligned holes. Under these circumstances, the inner cap is completely isolated from access and turning the outer cap will not rotate the inner cap 12 to allow the lock cap unit 10 to be removed.

Typically these lock cap units would be painted with the contractor's colors or symbol so that they can be easily identified. Further, because they cannot be removed without a key to the paddle lock, the tank is both secure against vandalism, and theft will unlikely occur when the locked cap unit is on the tank since stolen tanks with the unit installed cannot be easily marketed or exchanged.

Having described my invention I claim:

1. A security lock cap unit for gas supply tanks comprising:

a first cylindrical sleeve means having one end closed to form a first cap-like structure and having a slotted aperture in its end which is closed;

a second cylindrical sleeve means having one end closed forming a second cap-like structure, said cylindrical sleeve means having an outside diameter less than the inside diameter of said first cylindrical sleeve means and having a threaded mouth so it can be screwed onto a standard threaded boss of gas supply tanks, said second cylindrical sleeve means being axially received in said first cylindrical sleeve means so it is telescoped in a nested relationship with said first sleeve means with their respective closed ends adjacent to each other and allowing relative rotation therebetween said second cylindrical sleeve means being shorter in axial length than said first cylindrical sleeve means;

retaining means fixed to said first cylindrical sleeve means operable to retain said second cylindrical sleeve means therein in a manner which allows relative rotation between said sleeves means and limits relative axial movement therebetween;

locking means fixedly mounted on said first cylindrical sleeve means, said locking means including two spaced apart flanges fixedly secured to said first cylindrical sleeve means, one flange on each side of the slotted aperture in said first cylindrical sleeve means with said flanges in a parallel disposition, a flat key element disposed between said two flanges and pivotedly connected to said flanges, said key element operable to close the slotted aperture and to engage said second cylindrical sleeve means in a first pivoted position to prevent relative rotation between said sleeve means and to disengage from said second cylindrical sleeve means in a second pivoted position to allow relative rotation between said sleeve means and lock means operable to retain said key element in said second pivoted position whereby the lock cap cannot be removed from a gas cylinder on which it is afttached without releasing of the key element from the lock means and placing it in the first pivoted position.

2. The lock cap unit as defined in claim 1 wherein said second cylindrical sleeve means includes spaced apart lugs mounted circumferentially on its outer surface which are engaged by the key element when the latter is in its first pivoted position thereby preventing relative rotation between said first and second cylindrical sleeve means.

3. The lock cap unit defined in claim 1 wherein the first cylindrical sleeve means includes a central aperture in its closed end to vent gases from inside said sleeve means.

* * * * *